US005487200A

United States Patent [19]

Herzog

[11] Patent Number: 5,487,200

[45] Date of Patent: Jan. 30, 1996

[54] BOTTLE CLEANER

[76] Inventor: Kenneth J. Herzog, 200 Mill Rd., Riverhead, N.Y. 11901

[21] Appl. No.: 185,142

[22] Filed: Jan. 24, 1994

[51] Int. Cl.[6] ..... A47L 5/38

[52] U.S. Cl. ..... 15/1.51; 15/304; 15/309.2; 15/345

[58] Field of Search ..... 15/1.51, 304, 345, 15/346, 309.2

[56] References Cited

U.S. PATENT DOCUMENTS

| | | | |
|---|---|---|---|
| 2,282,474 | 5/1942 | Howard | 15/304 |
| 4,208,761 | 6/1980 | Ionescu | 15/304 |
| 4,883,542 | 11/1989 | Voneiff | 15/1.51 X |
| 5,265,298 | 11/1993 | Young | 15/309.2 X |
| 5,279,017 | 1/1994 | Foreshaw | 15/309.2 X |
| 5,351,354 | 10/1994 | Hasumi et al. | 15/1.51 |

*Primary Examiner*—Chris K. Moore

[57] ABSTRACT

A container cleaner apparatus is provided, wherein containers are conveyed to stations for cleaning consisting of a first assembly for supplying ionized air to the interior of the containers at the stations to neutralize static electricity therein. A second assembly is for vacuuming the interior of the containers at the stations, wherein dust, dirt, carton lint and other foreign matter is removed from the interior of the containers.

3 Claims, 3 Drawing Sheets

BOTTLE CLEANER

BACKGROUND OF THE INVENTION

The instant invention relates generally to cleaning devices and more specifically it relates to a container cleaner apparatus, which provides a mechanism to remove foreign matter from containers.

There are available various conventional cleaning devices which do not provide the novel improvements of the invention herein disclosed.

SUMMARY OF THE INVENTION

A primary object of the present invention is to provide a container cleaner apparatus that will overcome the shortcomings of the prior art devices.

Another object is to provide a container cleaner apparatus that will automatically remove dust, dirt, carton lint and other foreign matters from containers by utilizing high pressure, ionization, vacuuming and filtration.

An additional object is to provide a container cleaner apparatus that is completely automatic microprocessor controlled and can handle a wide range of container sizes and shapes with no change of parts.

A further object is to provide a container cleaner apparatus that is simple and easy to use.

A still further object is to provide a container cleaner apparatus that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
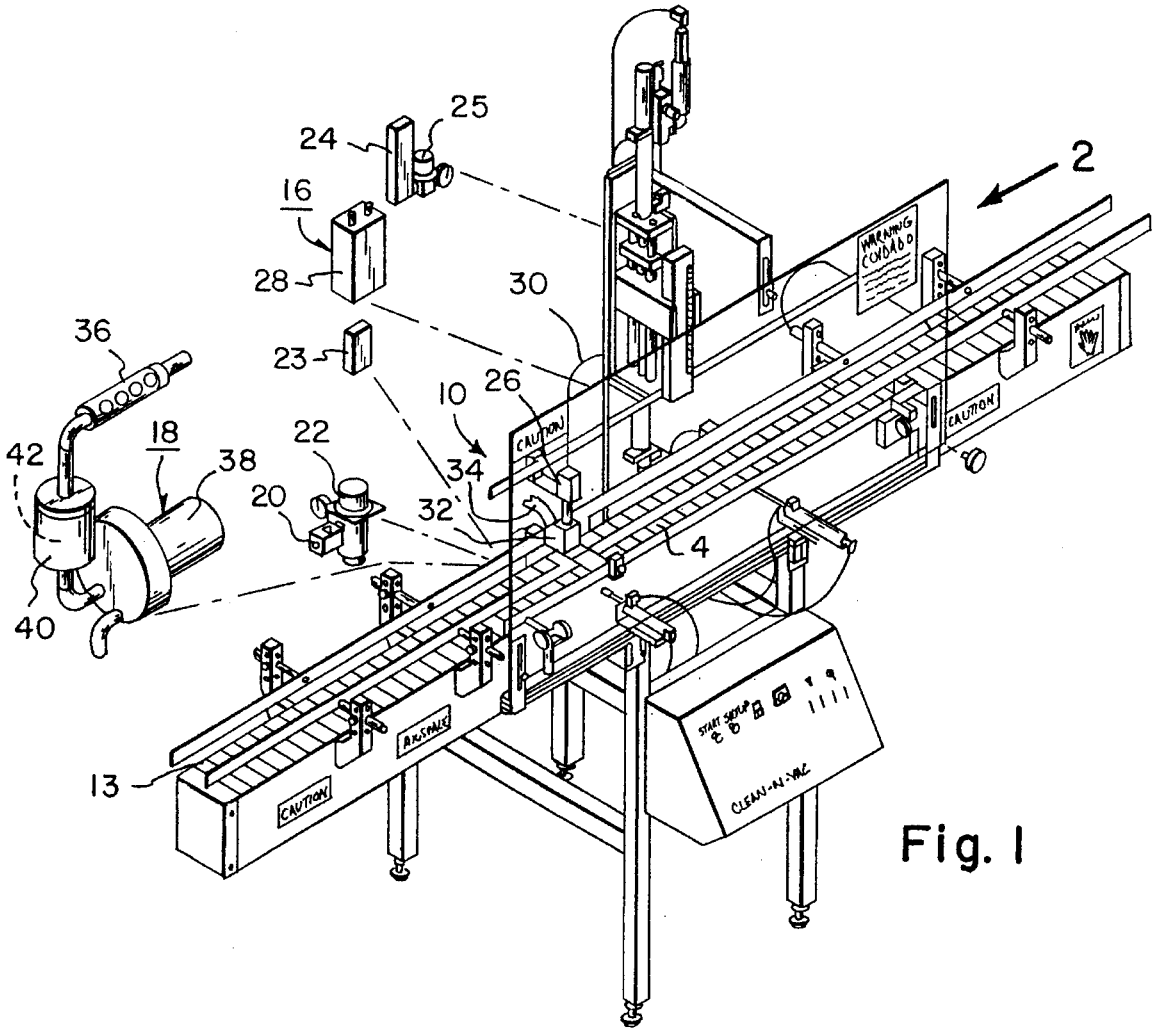
FIG. 1 is a perspective view of the instant invention with parts exploded therefrom.
Figure 2:
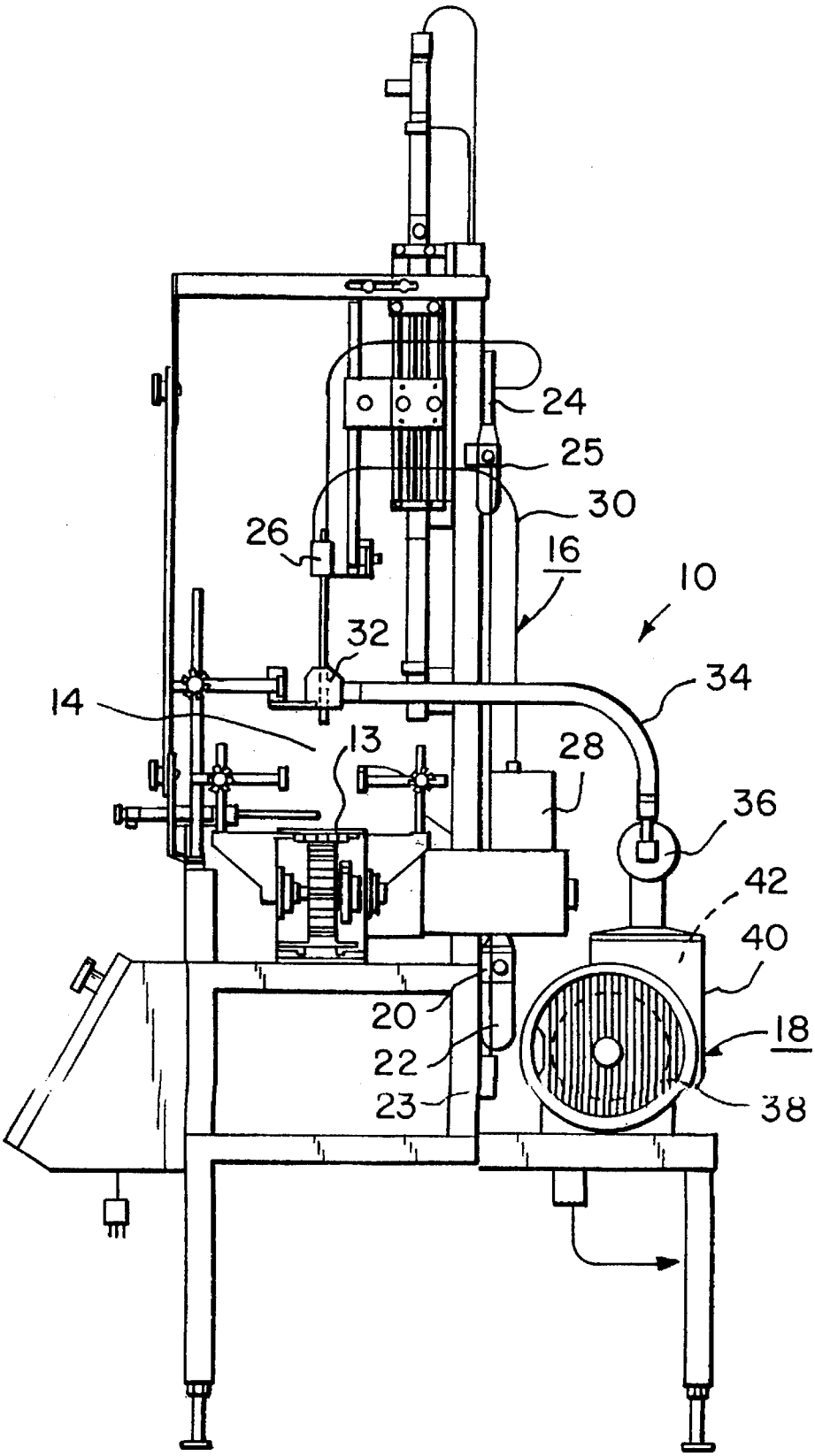
FIG. 2 is a right side view taken in the direction of arrow 2 in FIG. 1.
Figure 3:
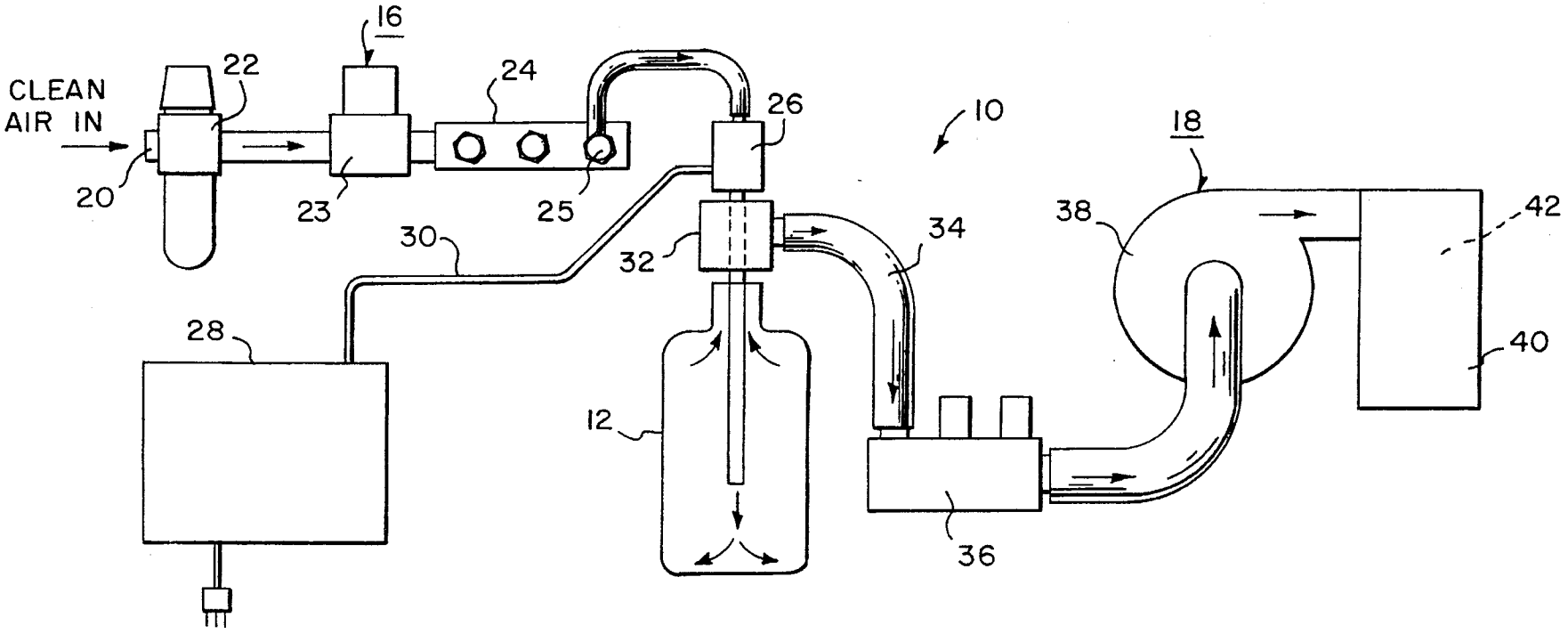
FIG. 3 is a simplified flow diagram of the container cleaner system therein.

Turning now descriptively to the drawings, in which similar reference characters denote similar elements throughout the several views, FIGS. 1 through 3 illustrate a container cleaner apparatus 10, wherein containers 12 are conveyed by a conveyor 13 to stations 14 for cleaning. A first assembly 16 is for supplying ionized air to the interior of the containers 12 at the stations 14, to neutralize static electricity therein. A second assembly 18 is for vacuuming the interior of the containers 12 at the stations 14, wherein dust, dirt, carton lint and other foreign matter is removed from the interior of the containers 12. Both the assemblies 16 and 18 are mounted together and function simultaneously.

The ionized air supplying assembly 16 includes a main air on/off valve 20 connected to a pressurized air line (not shown). A main supply filter regulator 22 is connected to the main air on/off valve 20. An air solenoid valve 23 is connected to the main supply filter regulator 22. An air manifold 24 is connected to the air solenoid valve 23. A plurality of air supply regulators 25 are connected to the air manifold 24. A plurality of ionizing nozzles 26 are each connected to one of the air supply regulators 25, to extend into one container 12 to be cleaned. An ionizing power unit 28 is provided, with a plurality of high voltage power cables 30. Each cable 30 extends between the ionizing power unit 28 and one ionizing nozzle 26.

The vacuuming assembly 18 includes a plurality of vacuum blocks 32, each mounted onto one ionizing nozzle 26 and above one container 12. A plurality of vacuum hoses 34 are provided, with each connected to one vacuum block 32. A vacuum manifold 36 is connected to the vacuum hoses 34. A vacuum motor/pump 38 is connected to the vacuum manifold 36. A filter housing 40 having a replacement filter 42 therein is connected to the vacuum motor/pump 38, to collect all of the dust, dirt, carton lint and other foreign matter that is removed from the interior of the containers 12, as shown in FIG. 3.

The filter housing 40 can also be placed between the vacuum manifold 36 and the vacuum motor/pump 38, as shown in FIGS. 1 and 2. The other various components of the container cleaner apparatus 10, shown in FIGS. 1 and 2 are not part of the invention, so that they are not described herein in detail.

OPERATION OF THE INVENTION

The ionizing nozzles 26 are lowered into the container 12. The air solenoid valve 23 opens to blow air into the containers 12. The vacuum motor/pump 38 runs continuously. The ionizing nozzles 26 rise, while the vacuum and ionized air remain on. As the ionizing nozzles 26 exit the containers 12, the air solenoid valve 23 closes. The next group of containers 12 are placed at the station 14 and the cleaning cycle repeats itself.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A container cleaner apparatus wherein containers are conveyed to stations for cleaning comprising:

a) a first means for supplying ionized air to the interior of the containers at the stations to neutralize static electricity therein;

b) a second means for vacuuming the interior of the containers at the stations, wherein dust, dirt, carton lint and other foreign matter is removed from the interior of the containers and c) a third means for moving said first and second means into and out of said containers; wherein said first and second means are mounted together and function simultaneously; including a fourth means for stopping flow of ionized air when said first means is out of said container

2. A container cleaner apparatus as recited in claim 1, wherein said first means includes:

a) a main air on/off valve connected to a pressurized air line;

b) a main supply filter regulator connected to said main air on/off valve;

c) an air solenoid valve connected to said main supply filter regulator;

d) an air manifold connected to said air solenoid valve;

e) a plurality of air supply regulators connected to said air manifold;

f) a plurality of ionizing nozzles, each connected to one of said air supply regulators, to extend into one container to be cleaned;

g) an ionizing power unit and h) a plurality of high voltage power cables, each extending between said ionizing power unit and one said ionizing nozzle.

3. A container cleaner apparatus as recited in claim 1; wherein said second means includes:

a) a plurality of vacuum blocks, each mounted onto one said ionizing nozzle and above one container;

b) a plurality of vacuum hoses, each connected to one said vacuum block;

c) a vacuum manifold connected to said vacuum hoses;

d) a vacuum motor/pump connected to said vacuum manifold and e) a filter housing having a replacement filter therein and connected to said vacuum motor/pump, to collect all of the dust, dirt, carton lint and other foreign matter that is removed from the interior of the containers.

* * * * *